US008393043B2

(12) United States Patent
Limongi et al.

(10) Patent No.: US 8,393,043 B2
(45) Date of Patent: Mar. 12, 2013

(54) APPLICATOR FOR COSMETIC PRODUCT

(75) Inventors: Michel Limongi, Clichy (FR); Vincent Lequeux, Paris (FR)

(73) Assignee: Albea Services (FR)

( * ) Notice: Subject to any disclaimer, the term of this patent is extended or adjusted under 35 U.S.C. 154(b) by 0 days.

(21) Appl. No.: 13/302,407

(22) Filed: Nov. 22, 2011

(65) Prior Publication Data

US 2012/0128399 A1 May 24, 2012

(30) Foreign Application Priority Data

Nov. 24, 2010 (FR) ..... 10 59686

(51) Int. Cl.
*A45D 33/36* (2006.01)

(52) U.S. Cl. ..... 15/209.1; 15/227; 15/229.14; 15/244.1; 132/320

(58) Field of Classification Search ..... 15/209.1, 15/210.1, 104.94, 227, 244.1, 229.13, 244.2, 15/244.4, 229.14; 132/320; 604/1
See application file for complete search history.

(56) References Cited

U.S. PATENT DOCUMENTS 2,964,772 A 12/1960 Crawford
5,771,524 A * 6/1998 Woods et al. ..... 15/209.1
5,900,068 A * 5/1999 Thomas ..... 134/6
6,493,898 B1 * 12/2002 Woods et al. ..... 15/209.1
6,575,172 B1 * 6/2003 Crosby ..... 132/74.5
D480,190 S * 9/2003 Brown ..... D32/52
2002/0026678 A1 * 3/2002 Gustafsson et al. ..... 15/209.1
2002/0026679 A1 * 3/2002 Widlund ..... 15/227

FOREIGN PATENT DOCUMENTS

GB 944467 12/1963

OTHER PUBLICATIONS

Search Report for corresponding French Application No. 1059686 day May 25, 2011.

* cited by examiner

*Primary Examiner* — Mark Spisich
*Assistant Examiner* — Michael Jennings
(74) *Attorney, Agent, or Firm* — Banner & Witcoff, Ltd.

(57) ABSTRACT

The invention concerns an applicator (1) for cosmetic product, comprising:
a pad element (2) having a first side for application of the cosmetic product and a second side opposite the first side, and a support element (3) comprising a central attached portion (8) and two side grasping portions (9, 10) arranged either side of the central attached portion (8), the central attached portion (8) being attached onto the second side (5) of the pad element (2),
wherein the support element (3) is formed from a planar blank having two slots, each slot forming a space separating the central attached portion (8) from a side grasping portion (9, 10).

11 Claims, 7 Drawing Sheets

APPLICATOR FOR COSMETIC PRODUCT

FIELD OF THE INVENTION

The invention concerns an applicator for a cosmetic product.

STATE OF THE ART

Applicators of <<powder puff>> type are known comprising a pad or soft sponge that is disc-shaped. These applicators are particularly adapted to be housed in cases containing a cosmetic product such as compact powder for example.

These applicators can be provided with a ribbon of which each end is attached close to the circumference of the pad. The ribbon forms grasping means enabling the user to slide fingers between the ribbon and the pad so as to grasp the applicator in order to take up and apply the cosmetic product.

One drawback of these applicators is that they have a tendency to deform under a tautening effect exerted by the ribbon when the user takes hold of this ribbon.

On this account, these applicators do not allow uniform application of the cosmetic product.

SUMMARY OF THE INVENTION

It is one objective of the invention to propose an applicator for cosmetic product which is both compact so that it can be housed in a case, and also allows more uniform application of the cosmetic product.

This problem is solved by the present invention by means of an applicator for cosmetic product, comprising:

- a pad element having a first side for application of the cosmetic product, and a second side opposite the first side, and
- a support element comprising a central attachment portion and two side grasping portions arranged either side of the central attachment portion, the central attachment portion being attached to the second side of the pad element, wherein the support element is formed from a planar blank having two slots, each slot forming a space separating the central attachment portion from the side grasping portions.

In said applicator, since the support element is formed from a planar blank it can easily be housed in a case.

In addition, the support element allows rigidity to be imparted to the applicator to support the pad element during application of the cosmetic product.

The support element can be formed of a single piece of material, in particular using a moulding process or cut-out process.

In both cases, the structure of the proposed applicator is particularly adapted for industrial manufacture. If a moulding process is used, a single moulding operation is needed to form the support element. If a cut-out process is used, a large number of support elements can be formed simultaneously by cutting out from a single sheet of plastic material.

The applicator may in addition have the following characteristics:

- each side grasping portion is mobile relative to the central portion,
- each side portion is capable of pivoting relative to the central portion between a storage position in which the side portion and the central portion extend over one same plane, and a position of use in which the side portion extends over a plane substantially perpendicular to the plane of the central portion,

- each side grasping portion is of arched shape,
- the support element comprises connecting portions, each connecting portion connecting a side portion to the central portion and being flexible to allow pivoting of the side portion relative to the central portion,
- the connecting portions are formed by thinned regions of the blank,
- the connecting portions are formed by regions of the blank of lesser thickness and/or lesser width,
- the slots are linear so that the central portion and the side portions have substantially mating shapes,
- the support element is of symmetrical shape,
- the support element has an opening, the central portion extending around the opening,
- the support element is formed of a single piece of material.

BRIEF DESCRIPTION OF THE DRAWINGS

Other characteristics and advantages will become further apparent from the following description which is solely illustrative and non-limiting, and is to be read with reference to the appended figures amongst which.

DETAILED DESCRIPTION OF ONE EMBODIMENT

Figure 1A:
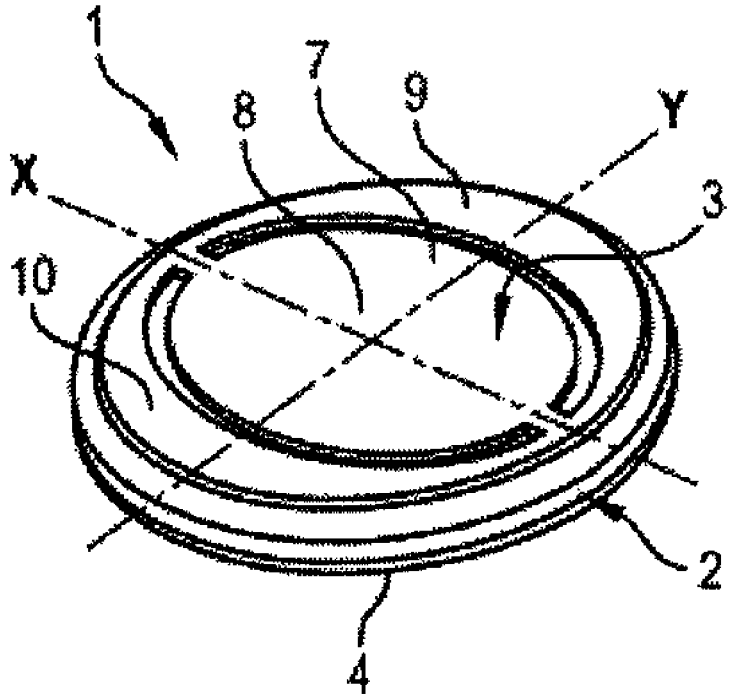
FIGS. 1A and 1B, giving a perspective view and side view, schematically illustrate an applicator conforming to a first embodiment of the invention, FIGS. 2A and 2B, giving an overhead and a detail view, schematically illustrate a first example of a support element for the applicator in FIGS. 1A and 1B, FIGS. 3A and 3B, giving an overhead and side view, schematically illustrate a second example of a support element for the applicator in FIGS. 1A and 1B, FIGS. 4 to 6 schematically illustrate an applicator in storage position and in position of use, FIGS. 7A and 7B, giving perspective and side views, schematically illustrate an applicator conforming to a second embodiment of the invention, FIGS. 8A and 8B, giving a perspective view and side view, schematically illustrate an applicator conforming to a third embodiment of the invention, FIGS. 9A and 9B, giving a perspective view and side view; schematically illustrate an applicator conforming to a fourth embodiment of the invention.
Figure 1B:
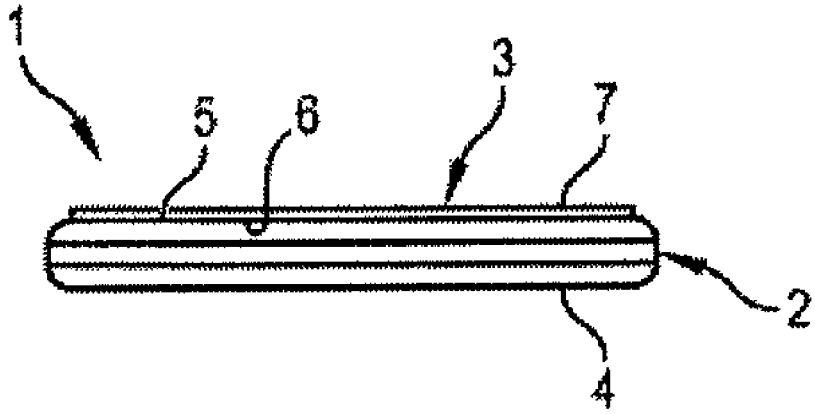

In FIGS. 1A and 1B, the applicator 1 comprises a pad element 2 and a support element 3.

The pad element 2 is in the general shape of a planar, circular disc. The pad element 2 has a first side 4 for application of the cosmetic product, and a second side 5 opposite the first side 4 for attaching the support element 3.

The pad element 2 is formed for example of a layer in a flexible, expanded material optionally covered on one side with a coating for taking up and applying the cosmetic product. The coating is typically a tuft or fabric such as cotton velveteen.

The support element 3 is formed in a single piece of material. The support element 3 is formed from a rigid, planar blank in plastic material, such as polypropylene for example. The support element 3 has a first side 6 in contact with the second side 5 of the pad element 2, and a second side 7 opposite the first side 6.

Figure 2A:
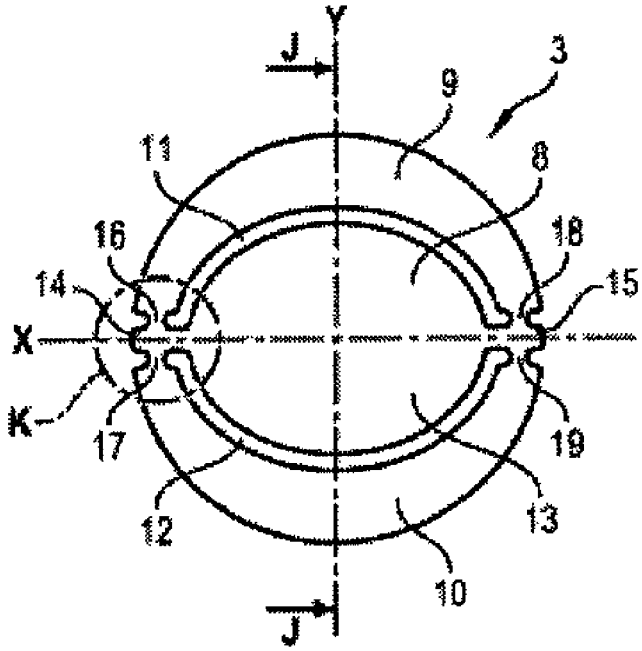
Figure 2B:
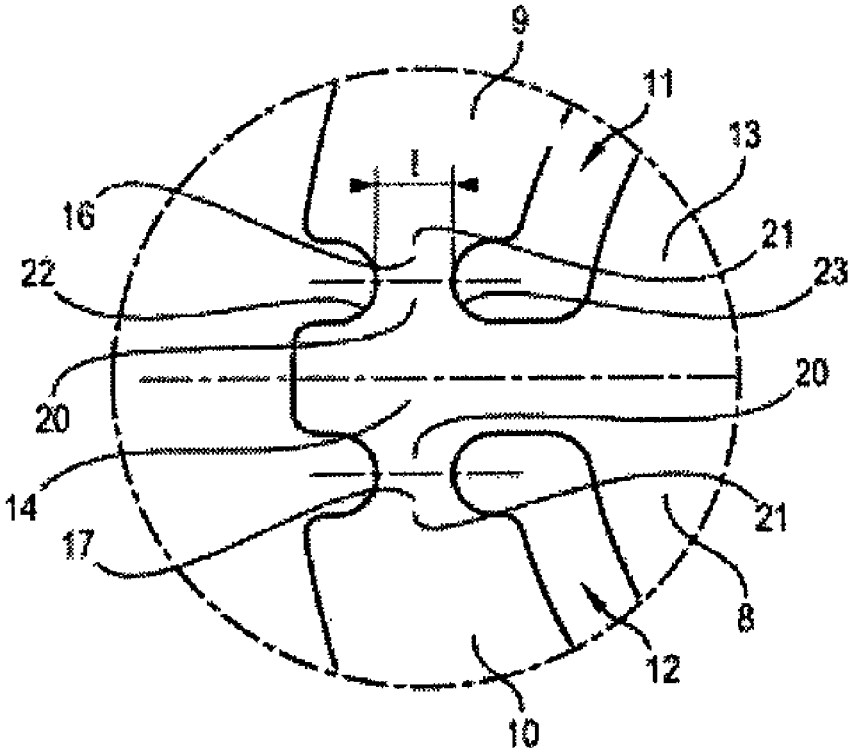

As is illustrated in FIGS. 2A and 2B, the blank used to form the support element 3 is in the general shape of a thin, circular disc.

The support element 3 is symmetrical firstly in relation to a first axis X and secondly in relation to a second axis Y perpendicular to the first axis X, the two axes extending parallel to the plane of the blank.

The support element 3 comprises a central attachment portion 8 attached by gluing onto the second side 5 of the pad element 2, and two side grasping portions 9 and 10 extending either side of the central portion 8 and arranged symmetrically relative to the axis X. The two side portions 9 and 10 are not attached to the pad element 2.

The central attachment portion 8 is separate from the side grasping portions 9 and 10 via two linear slots 11 and 12 formed in the blank. Each slot 11 and 12 has a curved shape which substantially follows the shape of an outside edge of the blank.

Therefore, the central portion 8 and the side portions 9 and 10 have substantially mating shapes.

Each side grasping portion 9 and 10 has an arched or crescent shape.

The central attachment portion 8 extending between the side portions 9 and 10 has a main region 13 of elliptical shape and two extensions 14 and 15 of substantially rectilinear shape extending either side of the main region 13 along axis X, the extensions 14 and 15 being arranged symmetrically relative to axis Y.

The support element 3 also comprises four connecting portions 16, 17, 18 and 19 connecting the central portion 8 and the side portions 9 and 10. More precisely, the connecting portions 16 and 18 connect the central portion 8 and the side portion 9 at the ends of the side portion 9. The connecting portions 17 and 19 connect the central portion 8 and the side portion 10 at the ends of the side portion 10.

As illustrated in FIGS. 2A, 2B, 3A and 3B, each connecting portion 16, 17, 18 and 19 comprises a thinned region 20 of the blank connecting one end 21 of a side grasping portion with an extension 14 of the central portion 8.

In the example illustrated in FIGS. 2A and 2B, each thinned region 20 has a dimension in the plane of the blank (width 1) which is smaller than the dimensions of the central portion 8 and of the side portions 9 and 10. In particular, each thinned region 20 is formed between two notches 22 and 23 made in the blank and facing each other. In this manner, each thinned region 20 forms a flexible region of the blank (or hinge) permitting pivoting of each side portion 9 and 10 relative to the central portion 8 about a rotation axis parallel to axis X.

The support element 3 illustrated in FIGS. 2A and 2B can be made by cutting out from a sheet of plastic material. The plastic material is preferably polypropylene which has characteristics of flexibility making it particularly suitable for forming hinges.

Figure 3A:
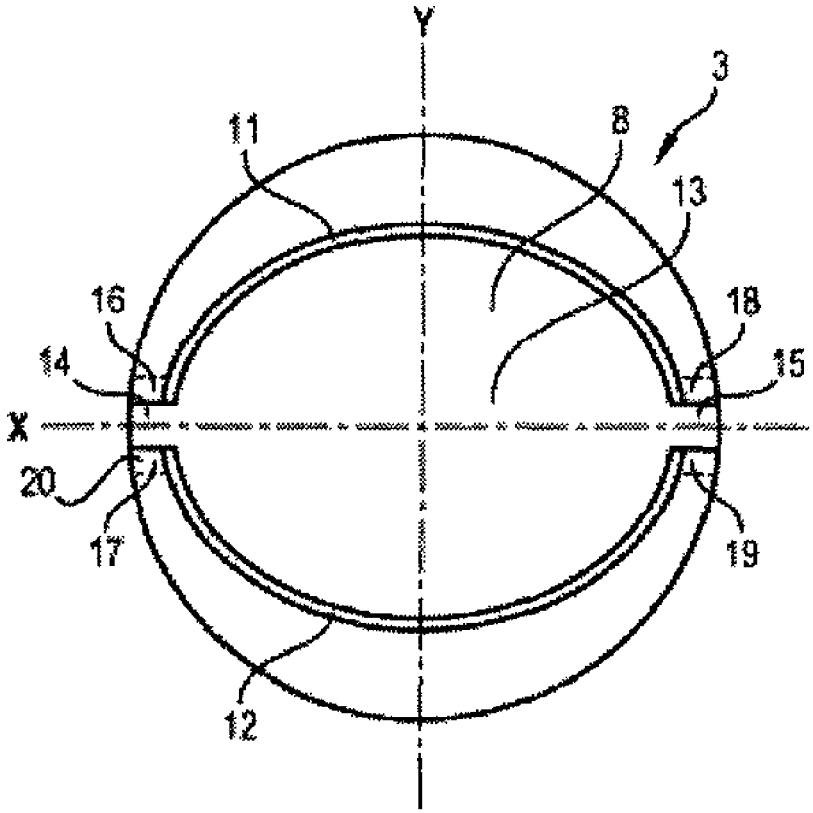
Figure 3B:
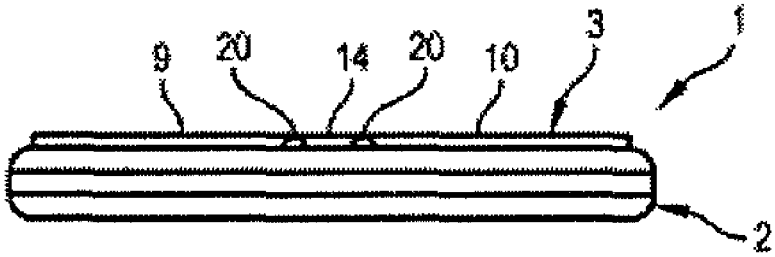

FIGS. 3A and 3B schematically illustrate a second example of a support element 3 for the applicator in FIGS. 1A and 1B. In this second example, the support element 3 is identical to the one in FIGS. 2A and 2B with the exception that each thinned region 20 is a region of lesser thickness formed in the blank. Each thinned region 20 has a dimension perpendicular to the plane of the blank (thickness e) which is smaller than the thickness of the central portion 8 and of the side portions 9 and 10. In this manner, each thinned region 20 forms a flexible region of the blank (or hinge) permitting the pivoting of each side portion 9 and 10 relative to the central portion 8 about a rotation axis parallel to the axis X.

The support element 3 illustrated in FIGS. 3A and 3B can be formed by injection moulding a plastic material. The plastic material is preferably polypropylene which has characteristics of flexibility making it particularly suitable for forming hinges.

Figure 4:
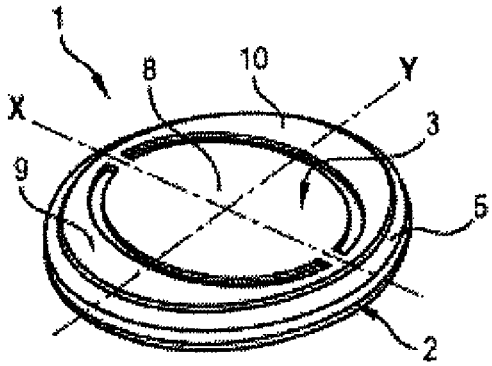
Figure 5:
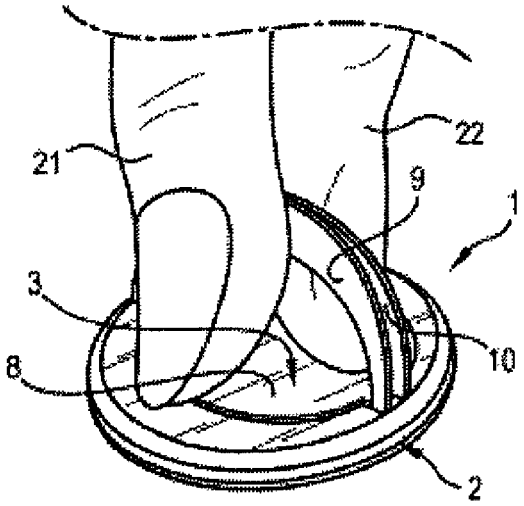
Figure 6:
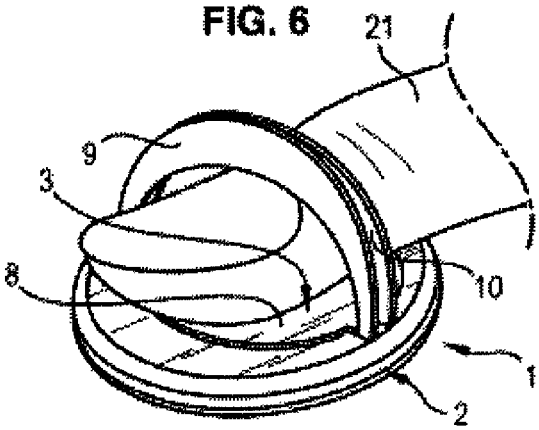

FIGS. 4 to 6 schematically illustrate an applicator 1 in storage position and in position of use.

In FIG. 4, the applicator 1 is in storage position. In this position, the side portions 9 and 10 and the central portion 8 extend over one same plane, namely the plane of the blank. The side portions 9 and 10 are folded back against the second side 5 of the pad element 2. Therefore, the applicator 1 is compact and can easily be stored in a case. The support element 3 maintains the pad element 2 in a substantially planar configuration and prevents the deterioration thereof.

In FIG. 5, the applicator 1 is in position of use. In this position, the side portions 9 and 10 have been pivoted relative to the central portion 8 and extend over a plane substantially perpendicular to the plane of the central portion 8. The user is able simultaneously to take hold of the side grasping portions 9 and 10 between fingers 21, 22 to manipulate the applicator 1. Since the side grasping portions 9 and 10 are arranged symmetrically relative to the central attaching portion 8, the applicator 1 can be handled with precision. In addition, the central portion 8 firstly allows the maintaining of the planar shape of the pad element 2 for uniform application of the cosmetic product, and secondly it prevents the user's fingers 21 and 22 from coming into contact with the application element 2 which is coated with cosmetic product.

FIG. 6 illustrates another possible manner of handling the applicator. The user can insert one or more fingers 21, 22 in between the side grasping portions 9, 10 and the central attaching portion 8. This is made possible by the arched shape of the side grasping portions.

Figure 7A:
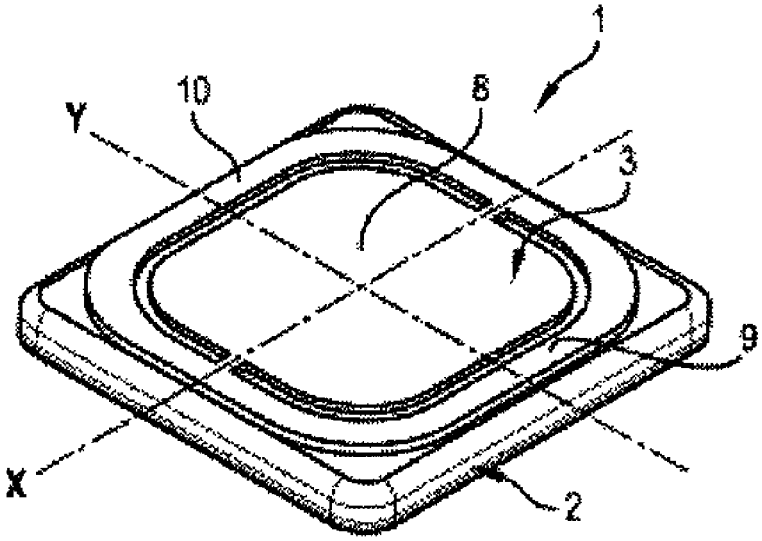
Figure 7B:
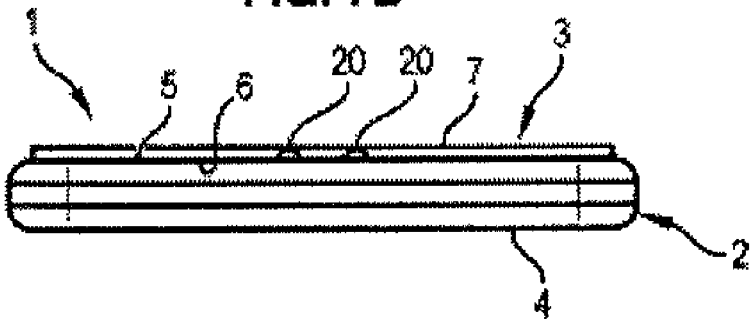

FIGS. 7A and 7B schematically illustrate an applicator 1 conforming to a second embodiment of the invention.

In this second embodiment, the pad element 2 and the support element 3 have a general, substantially square shape.

Figure 8A:
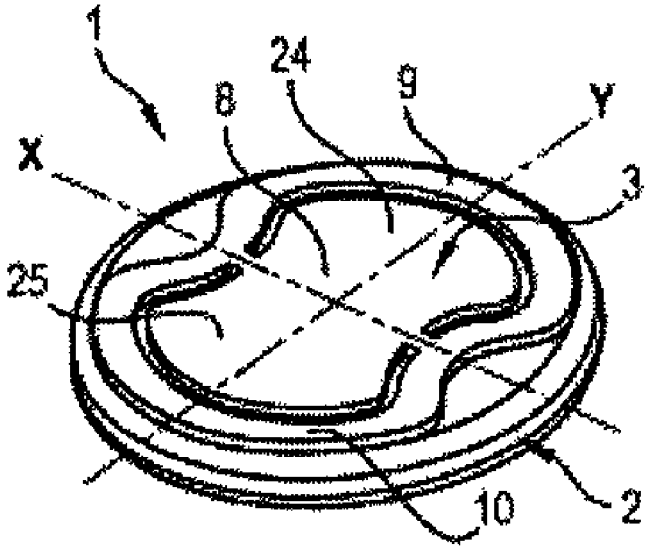
Figure 8B:
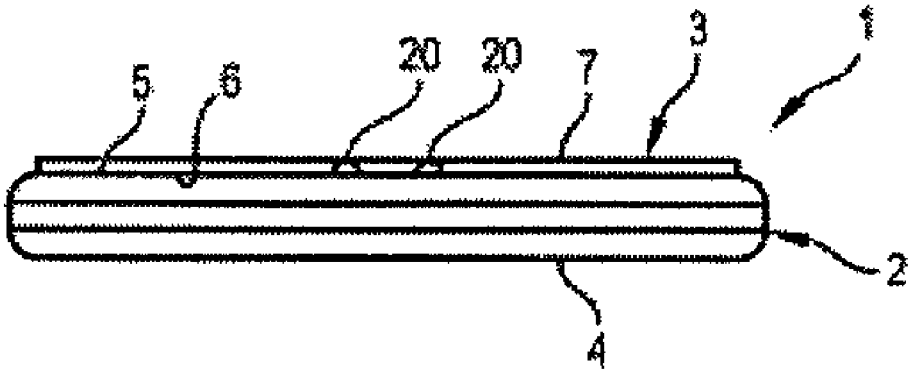

FIGS. 8A and 8B schematically show an applicator 1 conforming to a third embodiment of the invention.

In this third embodiment, the pad element 2 is of circular disc shape whilst the support element 3 is shaped with two lobes 24 and 25 arranged either side of the axis X. The cut-outs 11 and 12 follow the shape of the edge of the support element 3, so that the main region 13 of the central portion 8 also has two lobes extending either side of the axis X and flaring outwardly from this axis.

Figure 9A:
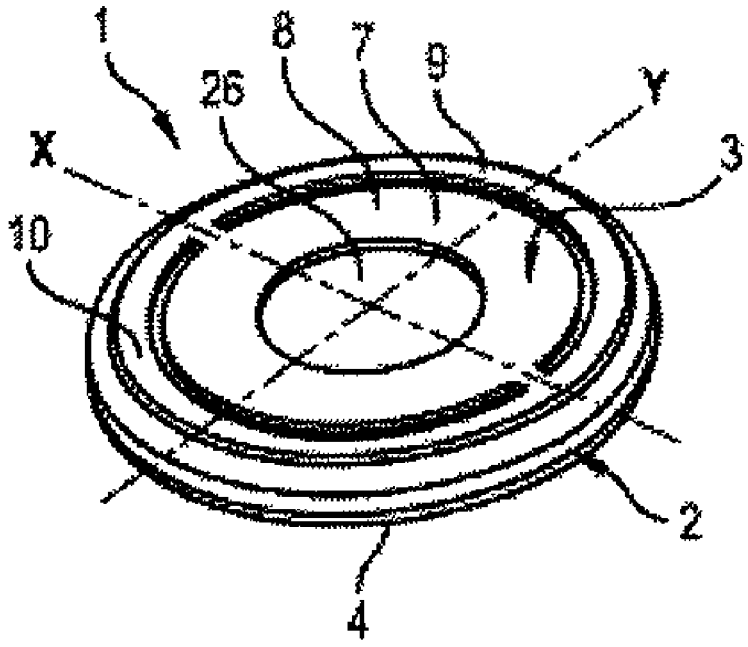
Figure 9B:
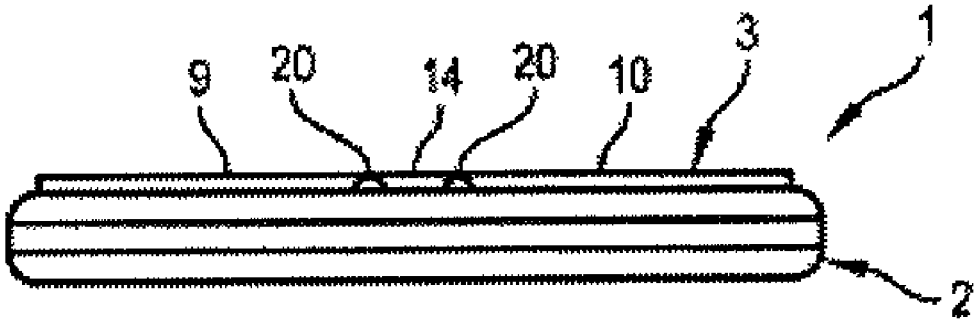

FIGS. 9A and 9B schematically illustrate an applicator 1 conforming to a fourth embodiment of the invention.

In this fourth embodiment, the pad element 2 and the support element 3 are of substantially circular shape.

In addition, the support element 3 comprises a substantially circular, central attachment portion 8 in which a central opening 26 is formed. The central opening 26 has a circular shape centred on the axes X and Y. In this manner, the central portion 8 is of general annular shape.

The central opening 26 allows flexibility to be imparted to a central part of the applicator, whilst the peripheral part of the applicator around the central part is maintained planar. The user can take hold of the applicator 1 as illustrated in FIG. 6 so as to position the tip of the finger at the central opening 26 in contact with the side 5 of the pad element. This enables the user to exert pressure directly on the pad element 2 through the opening 26 so that it is possible for example to apply cosmetic product to recessed parts of the face, such as the contours of the nose for example.

The invention claimed is:

1. An applicator for cosmetic product comprising:

a pad element having a first side for applying cosmetic product and a second side opposite the first side, and a support element comprising a central attachment portion and two side grasping portions arranged either side of the central attachment portion, the central attachment portion being attached to the second side of the pad element, wherein the support element is formed from a planar blank having two slots, each slot forming a space separating the central attachment portion from a side grasping portion;

wherein in a storage position, each side grasping portion and the central attachment portion extend over one same plane.

2. The applicator according to claim 1, wherein each side grasping side portion is mobile relative to the central attachment portion.

3. The applicator according to claim 1, wherein each side portion is capable of pivoting relative to the central attachment portion between the storage position, and a position of use in which the side grasping portion extends over a plane substantially perpendicular to the plane of the central attachment portion.

4. The applicator according to claim 1, wherein each side grasping portion is of arched shape.

5. The applicator according to claim 1, wherein the support element comprises connecting portions, each connection portion connecting a side grasping portion to the central attachment portion and being flexible to allow pivoting of the side grasping portion relative to the central attachment portion.

6. The applicator according to claim 5, wherein the connecting portions are formed by thinned regions of the blank.

7. The applicator according to claim 6, wherein the connecting portions are formed by regions of the blank of lesser thickness and/or of lesser width.

8. The applicator according to claim 1, wherein the slots are linear so that the central attachment portion and the side grasping portions have substantially mating shapes.

9. The applicator according to claim 1, wherein the support element is of symmetrical shape.

10. The applicator according to claim 1, wherein the support element has an opening, the central attachment portion extending around the opening.

11. The applicator according to claim 1, wherein the support element is formed of a single piece of material.

* * * * *